US007975343B2

(12) United States Patent
Hohlbein et al.

(10) Patent No.: US 7,975,343 B2
(45) Date of Patent: Jul. 12, 2011

(54) TOOTHBRUSH

(75) Inventors: Douglas J. Hohlbein, Pennington, NJ (US); Kenneth Waguespack, North Brunswick, NJ (US); Steven M. Sorrel, New York, NY (US); Bruce M. Russell, Howell, NJ (US)

(73) Assignee: Colgate-Palmolive Company, New York, NY (US)

( * ) Notice: Subject to any disclaimer, the term of this patent is extended or adjusted under 35 U.S.C. 154(b) by 1034 days.

(21) Appl. No.: 11/472,021

(22) Filed: Jun. 21, 2006

(65) Prior Publication Data

US 2006/0236478 A1 Oct. 26, 2006

Related U.S. Application Data

(63) Continuation-in-part of application No. 10/870,462, filed on Jun. 18, 2004, now Pat. No. 7,089,621, which is a continuation-in-part of application No. 10/601,106, filed on Jun. 20, 2003, now abandoned, and a continuation-in-part of application No. PCT/US03/30633, filed on Sep. 26, 2003, said application No. 10/870,462 is a continuation-in-part of application No. PCT/US03/29497, filed on Sep. 17, 2003, said application No. 10/870,462 is a continuation-in-part of application No. 29/189,729, filed on Sep. 10, 2003, now Pat. No. Des. 517,812, application No. 11/472,021, which is a continuation-in-part of application No. 10/869,922, filed on Jun. 18, 2004, now Pat. No. 7,143,462.

(60) Provisional application No. 60/414,117, filed on Sep. 27, 2002, provisional application No. 60/418,776, filed on Oct. 16, 2002, provisional application No. 60/419,425, filed on Oct. 18, 2002, provisional application No. 60/412,290, filed on Sep. 20, 2002.

(51) Int. Cl.
*A46B 9/04* (2006.01)

(52) U.S. Cl. ..... 15/110; 15/167.1

(58) Field of Classification Search ..... 15/110, 15/167.1, 22.1, 22.2, 28, 170, 167.2
See application file for complete search history.

(56) References Cited

U.S. PATENT DOCUMENTS 411,910 A 10/1889 Van Horne
585,358 A 6/1897 Gould
697,336 A 4/1902 Hagerty
(Continued)

FOREIGN PATENT DOCUMENTS

CH 99738 6/1923
(Continued)

OTHER PUBLICATIONS

European Search Report dated Mar. 11, 2008.
Office Action from the Patent Office of Russia for counterpart Russian Patent Application No. 2009101779/12(002206) dated Jan. 25, 2010 w/English translation.

*Primary Examiner* — Shay L Karls
(74) *Attorney, Agent, or Firm* — Judy W. Chung

(57) ABSTRACT

A toothbrush includes a head and a plurality of tooth cleaning elements for enhanced cleaning of the teeth. The tooth cleaning elements include cleaning elements that define a loop arrangement for better retention of the dentifrice, a central cleaning element disposed within the loop, two opposing arcuate cleaning elements disposed on opposite sides of the loop, peripheral cleaning element with a stepped and tapered construction, elongate distal cleaning elements, and proximal cleaning elements.

16 Claims, 5 Drawing Sheets

U.S. PATENT DOCUMENTS

| | | | | |
|---|---|---|---|---|
| 726,727 | A | | 4/1903 | Mills |
| 864,054 | A | | 8/1907 | Abrams |
| 907,842 | A | | 12/1908 | Meuzles |
| 1,002,468 | A | | 9/1911 | Strangman |
| 1,006,630 | A | | 10/1911 | Clarke |
| 1,125,532 | A | | 1/1915 | Himmel |
| 1,128,139 | A | | 2/1915 | Hoffman |
| 1,142,698 | A | | 6/1915 | Crumbaugh |
| 1,153,409 | A | | 9/1915 | Wheeler |
| 1,188,823 | A | | 6/1916 | Plank |
| 1,191,556 | A | | 7/1916 | Blake |
| 1,251,250 | A | | 12/1917 | Libby |
| 1,268,544 | A | | 6/1918 | Cates |
| 1,297,272 | A | | 3/1919 | Strang et al. |
| 1,405,279 | A | | 1/1922 | Cassedy |
| 1,470,710 | A | | 10/1923 | Davis |
| 1,495,675 | A | | 5/1924 | Colt |
| 1,526,267 | A | | 2/1925 | Dessau |
| 1,578,074 | A | | 3/1926 | Chandler |
| 1,588,785 | A | | 6/1926 | Van Sant |
| 1,598,224 | A | * | 8/1926 | Van Sant ..... 15/167.1 |
| 1,658,706 | A | | 2/1928 | Carrott |
| D75,971 | S | | 8/1928 | Faubert et al. |
| 1,704,564 | A | | 3/1929 | Friedland |
| 1,705,109 | A | | 3/1929 | Essbach |
| 1,728,956 | A | | 9/1929 | Damitzel |
| 1,741,143 | A | | 12/1929 | Chin |
| 1,816,582 | A | | 7/1931 | Heron |
| 1,817,585 | A | | 8/1931 | Samuel |
| 1,852,480 | A | | 4/1932 | Ruetz |
| 1,860,924 | A | | 5/1932 | Cooke |
| 1,861,347 | A | | 5/1932 | Johnson |
| 1,872,832 | A | | 8/1932 | Silverberg |
| 1,891,864 | A | | 12/1932 | Barrett |
| 1,892,068 | A | | 12/1932 | Metzler |
| 1,903,161 | A | | 3/1933 | Barkan |
| 1,910,414 | A | | 5/1933 | Varga |
| 1,924,152 | A | | 8/1933 | Coney et al. |
| 2,083,217 | A | | 7/1934 | Brothers et al. |
| 1,993,662 | A | | 3/1935 | Green |
| 1,993,763 | A | | 3/1935 | Touchstone |
| D099,352 | S | | 4/1936 | Grapp |
| 2,042,239 | A | | 5/1936 | Planding |
| 2,049,956 | A | | 8/1936 | Greenberg |
| 2,059,914 | A | | 11/1936 | Rosenberg |
| 2,079,728 | A | | 5/1937 | Arnold |
| 2,088,839 | A | | 8/1937 | Coney et al. |
| 2,117,174 | A | | 5/1938 | Jones |
| 2,129,082 | A | | 9/1938 | Byrer |
| 2,139,245 | A | | 12/1938 | Ogden |
| 2,140,307 | A | | 12/1938 | Belaschk et al. |
| 2,154,846 | A | | 4/1939 | Heymann et al. |
| 2,161,349 | A | | 6/1939 | Hadden |
| 2,186,005 | A | | 1/1940 | Casto |
| D122,815 | S | | 10/1940 | Crosby |
| 2,218,072 | A | | 10/1940 | Runnels |
| 2,219,753 | A | | 10/1940 | Seguin |
| 2,225,331 | A | | 12/1940 | Campbell |
| 2,233,936 | A | | 3/1941 | Campbell |
| 2,244,699 | A | | 6/1941 | Hosey |
| 2,253,210 | A | | 8/1941 | Psiharis |
| 2,253,910 | A | | 8/1941 | Luenz |
| 2,263,802 | A | | 11/1941 | Grusin |
| 2,279,355 | A | | 4/1942 | Wilensky |
| 2,305,461 | A | | 12/1942 | Spyra |
| 2,312,828 | A | | 3/1943 | Adamsson |
| 2,364,205 | A | | 12/1944 | Fuller |
| 2,405,029 | A | | 7/1946 | Gallanty et al. |
| 2,418,485 | A | | 4/1947 | Shipley |
| 2,443,461 | A | | 6/1948 | Kempster |
| 2,491,274 | A | | 12/1949 | McNeill |
| 2,512,059 | A | | 6/1950 | Haeusser |
| 2,543,999 | A | | 3/1951 | Voss |
| 2,545,814 | A | | 3/1951 | Kempster |
| D162,941 | S | | 4/1951 | Ehrman |
| 2,554,777 | A | | 5/1951 | Dangin |
| 2,574,654 | A | | 11/1951 | Moore |
| 2,583,750 | A | | 1/1952 | Runnels |
| 2,637,870 | A | | 5/1953 | Cohen |
| 2,642,604 | A | | 6/1953 | Ferrari |
| 2,651,068 | A | | 9/1953 | Seko |
| 2,686,325 | A | | 8/1954 | Silver |
| 2,702,914 | A | | 3/1955 | Kittle et al. |
| 2,708,762 | A | | 5/1955 | Kling et al. |
| 3,103,027 | A | | 9/1963 | Birch |
| 3,103,680 | A | | 9/1963 | Krichmar |
| 3,153,800 | A | | 10/1964 | Trotin |
| 3,181,193 | A | | 5/1965 | Nobles et al. |
| 3,195,537 | A | | 7/1965 | Blasi |
| 3,230,562 | A | | 1/1966 | Birch |
| 3,254,356 | A | | 6/1966 | Yao et al. |
| 3,258,805 | A | | 7/1966 | Rossnan |
| 3,261,354 | A | | 7/1966 | Shpuntoff |
| 3,315,296 | A | | 4/1967 | Richardson |
| 3,337,893 | A | | 8/1967 | Fine et al. |
| 3,359,588 | A | | 12/1967 | Kobler |
| D213,669 | S | | 4/1969 | Miller |
| 3,491,396 | A | | 1/1970 | Eannarino et al. |
| 3,509,874 | A | | 5/1970 | Stillman |
| 3,553,759 | A | | 1/1971 | Kramer et al. |
| 3,610,043 | A | | 10/1971 | Wemyss |
| 3,633,237 | A | | 1/1972 | Bagube |
| 3,638,270 | A | | 2/1972 | Schlegel, Jr. et al. |
| 3,939,522 | A | | 2/1976 | Shimizu |
| 4,128,910 | A | | 12/1978 | Nakata et al. |
| 4,249,521 | A | | 2/1981 | Gueret |
| 4,277,862 | A | | 7/1981 | Weideman |
| 4,292,705 | A | | 10/1981 | Stouffer |
| 4,299,208 | A | | 11/1981 | Bianc |
| 4,328,604 | A | | 5/1982 | Adams |
| 4,356,585 | A | | 11/1982 | Protell et al. |
| 4,364,142 | A | | 12/1982 | Pangle |
| D272,683 | S | | 2/1984 | Stocchi |
| D272,687 | S | | 2/1984 | Stocchi |
| D272,689 | S | | 2/1984 | Stocchi |
| D272,690 | S | | 2/1984 | Stocchi |
| D273,635 | S | | 5/1984 | Stocchi |
| 4,455,704 | A | | 6/1984 | Williams |
| 4,461,285 | A | | 7/1984 | Courtin |
| 4,488,327 | A | | 12/1984 | Snider |
| 4,493,125 | A | | 1/1985 | Collis |
| 4,573,920 | A | | 3/1986 | d'Argembeau |
| 4,592,108 | A | | 6/1986 | Svendsen |
| 4,607,411 | A | | 8/1986 | Lewis, Jr. |
| 4,610,043 | A | | 9/1986 | Vezjak |
| D287,072 | S | | 12/1986 | Pfleger |
| 4,628,564 | A | | 12/1986 | Youssef |
| D295,695 | S | | 5/1988 | Golzari |
| 4,827,551 | A | | 5/1989 | Maser et al. |
| 4,888,844 | A | | 12/1989 | Maggs |
| D309,528 | S | | 7/1990 | Valenti |
| 5,005,246 | A | | 4/1991 | Yen-Hul |
| 5,027,796 | A | | 7/1991 | Linzey |
| 5,032,082 | A | | 7/1991 | Herrera |
| 5,040,260 | A | | 8/1991 | Michaels |
| 5,120,225 | A | | 6/1992 | Amit |
| 5,165,761 | A | | 11/1992 | Dirksing |
| 5,176,427 | A | | 1/1993 | Weihrauch |
| 5,211,494 | A | | 5/1993 | Baijnath |
| 5,226,197 | A | | 7/1993 | Nack et al. |
| 5,230,118 | A | | 7/1993 | Chamma |
| 5,242,235 | A | | 9/1993 | Li |
| 5,249,327 | A | | 10/1993 | Hing |
| D340,808 | S | | 11/1993 | Sherman et al. |
| 5,273,425 | A | | 12/1993 | Hoagland |
| D345,256 | S | | 3/1994 | Khin |
| 5,305,489 | A | | 4/1994 | Lage |
| 5,313,909 | A | * | 5/1994 | Tseng et al. ..... 116/208 |
| 5,335,389 | A | | 8/1994 | Curtis et al. |
| 5,341,537 | A | | 8/1994 | Curtis et al. |
| D350,851 | S | | 9/1994 | Spence, Jr. |
| 5,353,460 | A | | 10/1994 | Bauman |
| 5,373,600 | A | | 12/1994 | Stojanovski et al. |
| 5,392,483 | A | | 2/1995 | Heinzelman et al. |
| 5,396,678 | A | | 3/1995 | Bredall et al. |
| 5,398,369 | A | | 3/1995 | Heinzelman et al. |
| 5,438,726 | A | | 8/1995 | Leite |

5,445,825 A 8/1995 Copelan et al.
5,446,940 A 9/1995 Curtis et al.
5,511,273 A 4/1996 Carroll
D371,680 S 7/1996 Juhlin et al.
5,530,981 A 7/1996 Chen
5,535,474 A 7/1996 Salazar
5,570,487 A 11/1996 Schneider
D376,695 S 12/1996 Tveras
5,584,690 A 12/1996 Maassarani
5,604,951 A * 2/1997 Shipp ..... 15/167.1
5,613,262 A 3/1997 Choy-Maldonado
5,625,916 A 5/1997 McDougall
5,628,082 A 5/1997 Moskovich
D386,905 S 12/1997 Brady et al.
5,709,004 A 1/1998 Paduano et al.
D390,706 S 2/1998 Hohlbein et al.
D391,769 S 3/1998 Kling et al.
5,729,858 A 3/1998 Riffel
5,735,011 A 4/1998 Asher
5,735,012 A 4/1998 Heinzelman et al.
5,735,864 A 4/1998 Heisinger, Jr.
5,758,380 A 6/1998 Vrignaud
5,766,193 A 6/1998 Millner
D396,288 S 7/1998 Samuel
5,778,475 A 7/1998 Garcia
5,778,476 A 7/1998 Squillaci et al.
5,779,654 A 7/1998 Foley et al.
5,784,742 A 7/1998 Giuliani et al.
D397,219 S 8/1998 Rangel et al.
5,792,159 A 8/1998 Amin
5,799,353 A 9/1998 Oishi et al.
5,802,656 A 9/1998 Dawson et al.
5,806,127 A 9/1998 Samoil et al.
5,809,608 A 9/1998 Zadro
5,810,856 A 9/1998 Tveras
D399,349 S 10/1998 Barth
5,817,114 A 10/1998 Anderson et al.
5,818,856 A 10/1998 Injeyan et al.
RE35,941 E 11/1998 Stansbury, Jr.
D401,069 S 11/1998 Lamond et al.
D402,116 S 12/1998 Magloff et al.
5,842,247 A 12/1998 Decesare et al.
5,845,358 A 12/1998 Woloch
D403,510 S 1/1999 Menke et al.
D404,205 S 1/1999 Hohlbein
D404,206 S 1/1999 Hohlbein
5,860,183 A 1/1999 Kam
D405,272 S 2/1999 Khalaj et al.
5,873,140 A 2/1999 Holloway
D407,221 S 3/1999 Van Gelder
D407,222 S 3/1999 Van Gelder
D407,223 S 3/1999 Van Gelder
5,875,510 A 3/1999 Lamond et al.
5,896,614 A 4/1999 Flewitt
5,913,346 A 6/1999 Narwani
5,915,433 A 6/1999 Hybler
D412,064 S 7/1999 Achepohl et al.
5,920,941 A 7/1999 Iannotta
5,928,254 A 7/1999 Jensen
5,930,860 A 8/1999 Shipp
5,930,861 A 8/1999 White
5,938,673 A 8/1999 DePierro et al.
D413,728 S 9/1999 Waguespack et al.
5,946,759 A 9/1999 Cann
5,951,578 A 9/1999 Jensen
5,957,942 A 9/1999 Yudelman
5,967,152 A 10/1999 Rimkus
5,970,564 A 10/1999 Inns et al.
D416,685 S 11/1999 Overthun
5,974,614 A 11/1999 Ross
5,980,541 A 11/1999 Tenzer
5,980,542 A 11/1999 Saldivar
5,984,935 A 11/1999 Welt et al.
5,991,959 A 11/1999 Raven et al.
D418,979 S 1/2000 Moskovich et al.
D418,981 S 1/2000 Cheong et al.
D419,304 S 1/2000 Moskovich et al.
6,015,293 A 1/2000 Rimkus
D419,773 S 2/2000 Beals et al.
D420,515 S 2/2000 Van Gelder
D420,802 S 2/2000 Cheong et al.
D420,804 S 2/2000 Juhlin et al.
6,026,828 A 2/2000 Altshuler
6,029,304 A * 2/2000 Hulke et al. ..... 15/105
D421,841 S 3/2000 Achepohl et al.
D421,844 S 3/2000 Stark et al.
6,032,315 A 3/2000 Liebel
6,041,467 A 3/2000 Roberts et al.
6,041,468 A 3/2000 Chen et al.
D422,143 S 4/2000 Beals et al.
D422,413 S 4/2000 Goldinger et al.
6,044,514 A * 4/2000 Kaneda et al. ..... 15/167.1
D423,785 S 5/2000 Karallis
D423,786 S 5/2000 Zelinski
D423,787 S 5/2000 Musciano
D424,808 S 5/2000 Beals et al.
D424,809 S 5/2000 Bernard
D425,306 S 5/2000 Beals et al.
6,058,541 A 5/2000 Masterman et al.
6,065,176 A * 5/2000 Watanabe et al. ..... 15/167.1
6,067,684 A 5/2000 Kweon
D427,437 S 7/2000 Vonarburg
D428,702 S 8/2000 Van Gelder
6,098,233 A 8/2000 Chen
6,105,191 A 8/2000 Chen et al.
6,108,851 A 8/2000 Bredall et al.
6,108,869 A 8/2000 Meessmann et al.
6,119,296 A 9/2000 Noe et al.
6,131,228 A 10/2000 Chen et al.
6,151,745 A 11/2000 Roberts et al.
D434,906 S 12/2000 Beals et al.
6,168,434 B1 1/2001 Bohm-Van Diggelen
6,171,323 B1 1/2001 Potti et al.
6,182,365 B1 2/2001 Tseng et al.
D439,412 S 3/2001 Volpenhein et al.
D440,767 S 4/2001 Moskovich et al.
6,254,390 B1 7/2001 Wagner
6,260,227 B1 7/2001 Fulop et al.
6,276,021 B1 8/2001 Hohlbein
D448,174 S 9/2001 Harris et al.
6,289,545 B1 9/2001 Molster
D448,569 S 10/2001 Harris et al.
D450,457 S 11/2001 Hohlbein
D450,929 S 11/2001 Angelini et al.
6,311,358 B1 11/2001 Soetewey et al.
6,319,332 B1 11/2001 Gavney, Jr. et al.
6,322,573 B1 11/2001 Murayama
D452,615 S 1/2002 Cheong et al.
D453,270 S 2/2002 Choong
6,345,405 B1 2/2002 Brackin
D453,998 S 3/2002 Ping
D454,252 S 3/2002 Lee
6,352,545 B1 3/2002 Wagner
6,353,958 B2 3/2002 Weihrauch
RE37,625 E 4/2002 Wieder et al.
D456,139 S 4/2002 Hohlbein
6,374,448 B2 4/2002 Seifert
D457,323 S 5/2002 Hohlbein
D457,325 S 5/2002 Wilson et al.
6,383,202 B1 5/2002 Rosenblood
6,389,634 B1 5/2002 Devlin et al.
D458,453 S 6/2002 Baertschi
D459,086 S 6/2002 Belton et al.
D459,087 S 6/2002 Pfleger
6,402,768 B1 6/2002 Liebel
6,408,476 B1 6/2002 Cann
6,421,867 B1 7/2002 Weihrauch
D461,313 S 8/2002 Hohlbein
D461,959 S 8/2002 Chan et al.
D462,178 S 9/2002 Moskovich et al.
D462,528 S 9/2002 Crossman et al.
D463,131 S 9/2002 Winter et al.
D463,132 S 9/2002 Winter et al.
D463,133 S 9/2002 Hohlbein
6,442,785 B1 * 9/2002 Robinson ..... 15/167.1
6,446,295 B1 9/2002 Calabrese
6,625,839 B2 9/2002 Fischer
D463,668 S 10/2002 Yoshimoto et al.

| | | | |
|---|---|---|---|
| D464,796 | S | 10/2002 | Winter et al. |
| 6,463,618 | B1 | 10/2002 | Zimmer |
| 6,463,619 | B2 | 10/2002 | Gavney, Jr. |
| D465,847 | S | 11/2002 | Jacobs |
| D465,927 | S | 11/2002 | Saindon et al. |
| D466,302 | S | 12/2002 | Ping |
| D466,303 | S | 12/2002 | Saindon et al. |
| D466,694 | S | 12/2002 | Saindon et al. |
| 6,496,999 | B1 | 12/2002 | Gleason et al. |
| 6,510,575 | B2 | 1/2003 | Calabrese et al. |
| D469,958 | S | 2/2003 | Saindon et al. |
| 6,513,182 | B1 | 2/2003 | Calabrese et al. |
| D471,276 | S | 3/2003 | Potti |
| D471,362 | S | 3/2003 | Moskovich et al. |
| 6,546,586 | B2 | 4/2003 | Cho |
| D474,608 | S | 5/2003 | Hohlbein |
| D475,531 | S | 6/2003 | Klimeck et al. |
| D476,158 | S | 6/2003 | Ling |
| 6,571,417 | B1 | 6/2003 | Gavney, Jr. |
| D477,465 | S | 7/2003 | Reilly et al. |
| D478,211 | S | 8/2003 | Ping |
| D478,213 | S | 8/2003 | Ping |
| D478,424 | S | 8/2003 | Saindon et al. |
| D478,425 | S | 8/2003 | Ping |
| D478,727 | S | 8/2003 | Wong |
| D479,046 | S | 9/2003 | Winkler |
| D479,047 | S | 9/2003 | Wong |
| D479,914 | S | 9/2003 | Choong |
| D480,213 | S | 10/2003 | Ping |
| D480,562 | S | 10/2003 | Saindon et al. |
| D482,199 | S | 11/2003 | De Salvo |
| 6,647,581 | B1 | 11/2003 | Persad et al. |
| D483,183 | S | 12/2003 | De Salvo |
| D483,184 | S | 12/2003 | Geiberger et al. |
| D483,568 | S | 12/2003 | Jamson |
| 6,654,979 | B2 | 12/2003 | Calabrese |
| 6,658,688 | B2 | 12/2003 | Gavney, Jr. et al. |
| 6,665,901 | B2 | 12/2003 | Driesen et al. |
| D486,649 | S | 2/2004 | Sprosta et al. |
| 6,687,940 | B1 | 2/2004 | Gross et al. |
| D487,195 | S | 3/2004 | Winkler |
| 6,729,789 | B2 | 5/2004 | Gordon |
| 6,735,804 | B2 | 5/2004 | Carlucci et al. |
| 6,817,054 | B2 | 11/2004 | Moskovich et al. |
| 6,859,969 | B2 * | 3/2005 | Gavney et al. ..... 15/117 |
| D503,538 | S | 4/2005 | Desalvo |
| D456,607 | S | 5/2005 | Carlucci et al. |
| 6,886,207 | B1 | 5/2005 | Solanki |
| 6,895,629 | B1 | 5/2005 | Wenzler |
| 2001/0014232 | A1 | 8/2001 | Suda |
| 2001/0023516 | A1 | 9/2001 | Driesen et al. |
| 2001/0041903 | A1 | 11/2001 | Richard |
| 2001/0042280 | A1 | 11/2001 | Moskovich et al. |
| 2002/0004964 | A1 | 1/2002 | Luchino et al. |
| 2002/0019645 | A1 | 2/2002 | Fischer et al. |
| 2002/0029988 | A1 | 3/2002 | Blaustein et al. |
| 2002/0059685 | A1 | 5/2002 | Paffrath |
| 2002/0108194 | A1 | 8/2002 | Carlucci et al. |
| 2002/0124333 | A1 | 9/2002 | Hafliger et al. |
| 2002/0124337 | A1 | 9/2002 | Calabrese et al. |
| 2002/0138926 | A1 | 10/2002 | Brown, Jr. et al. |
| 2002/0138928 | A1 | 10/2002 | Calabrese |
| 2002/0152564 | A1 | 10/2002 | Blaustein et al. |
| 2002/0162180 | A1 | 11/2002 | Blaustein et al. |
| 2003/0009837 | A1 | 1/2003 | Cann |
| 2003/0033680 | A1 | 2/2003 | Davies et al. |
| 2003/0033682 | A1 | 2/2003 | Davies et al. |
| 2003/0115699 | A1 | 6/2003 | Wagstaff |
| 2003/0116884 | A1 | 6/2003 | Wagstaff |
| 2003/0163149 | A1 | 8/2003 | Heisinger, Jr. |
| 2003/0167582 | A1 | 9/2003 | Fischer et al. |
| 2003/0192139 | A1 | 10/2003 | Fattori et al. |
| 2003/0196283 | A1 | 10/2003 | Eliav et al. |
| 2003/0208865 | A1 | 11/2003 | Davies |
| 2003/0216762 | A1 | 11/2003 | Levit |
| 2003/0229959 | A1 | 12/2003 | Gavney |
| 2004/0006837 | A1 | 1/2004 | Cann |
| 2004/0025275 | A1 | 2/2004 | Moskovich et al. |
| 2004/0068810 | A1 | 4/2004 | Lee |
| 2004/0134007 | A1 | 7/2004 | Davies |
| 2004/0200748 | A1 | 10/2004 | Klassen et al. |
| 2004/0255416 | A1 | 12/2004 | Hohlbein |
| 2005/0000049 | A1 | 1/2005 | Hohlbein |
| 2005/0069372 | A1 | 3/2005 | Hohlbein et al. |
| 2006/0057087 | A1 | 3/2006 | Moskovich et al. |

FOREIGN PATENT DOCUMENTS

| | | | |
|---|---|---|---|
| CN | 99225704 | | 11/1999 |
| CN | 992257042 | | 11/1999 |
| DE | 857128 | | 11/1952 |
| DE | 2930459 | | 2/1981 |
| DE | 3114507 | | 3/1983 |
| DE | 3114507 | A1 | 3/1983 |
| DE | 3639424 | | 6/1988 |
| DE | 3639424 | A1 | 6/1988 |
| EP | 360766 | | 1/1990 |
| EP | 0449655 | | 5/1995 |
| EP | 0875169 | | 4/1998 |
| EP | 0875169 | A | 4/1998 |
| EP | 1034721 | | 9/2000 |
| EP | 1308108 | | 5/2003 |
| EP | 1308108 | A1 | 5/2003 |
| EP | 1425989 | | 6/2004 |
| FR | 537979 | | 6/1922 |
| FR | 2594307 | | 4/1987 |
| FR | 2594307 | A1 | 4/1987 |
| FR | 2636818 | | 9/1988 |
| FR | 2793136 | | 5/1999 |
| GB | 17643 | | 4/1912 |
| GB | 388246 | | 2/1933 |
| GB | 495982 | | 11/1938 |
| GB | 2040161 | | 1/1979 |
| GB | 2371217 | | 7/2002 |
| GB | 2371217 | A | 7/2002 |
| GB | 2391462 | | 2/2004 |
| GB | 2 375 705 | B | 1/2005 |
| GB | 2375705 | | 11/2005 |
| JP | 51-35303 | | 8/1976 |
| JP | 9-182626 | | 7/1997 |
| JP | 10-42957 | | 2/1998 |
| JP | 2000-278899 | | 10/2000 |
| JP | 2000278899 | | 10/2000 |
| JP | 2000-308522 | | 11/2000 |
| JP | 2000-308522 | A | 11/2000 |
| JP | 2000308522 | | 11/2000 |
| JP | 2001-314232 | | 11/2001 |
| JP | 2001314232 | A | 11/2001 |
| JP | 2002-142867 | | 5/2002 |
| JP | 2002142867 | | 5/2002 |
| RU | 1708283 | | 1/1992 |
| RU | 2122337 | | 11/1998 |
| SU | 1708283 | | 1/1992 |
| WO | WO 96/15696 | | 5/1996 |
| WO | WO 97/03587 | | 2/1997 |
| WO | 9805241 | | 2/1998 |
| WO | WO 98/05241 | | 2/1998 |
| WO | 9808458 | | 3/1998 |
| WO | 9809573 | | 3/1998 |
| WO | WO 98/08458 | | 3/1998 |
| WO | WO 98/09573 | | 3/1998 |
| WO | WO 98/18364 | | 5/1998 |
| WO | WO 98/22000 | | 5/1998 |
| WO | WO 99/01054 | | 1/1999 |
| WO | WO 99/07251 | | 2/1999 |
| WO | WO 99/37182 | | 7/1999 |
| WO | 9949754 | A1 | 10/1999 |
| WO | WO 99/49754 | | 10/1999 |
| WO | WO 00/64307 | | 2/2000 |
| WO | 0053054 | | 9/2000 |
| WO | WO 00/53054 | | 9/2000 |
| WO | 0064307 | | 11/2000 |
| WO | WO 01/01817 | | 1/2001 |
| WO | 0117433 | A1 | 3/2001 |
| WO | WO 01/17433 | | 3/2001 |
| WO | 0145573 | A1 | 6/2001 |
| WO | WO 01/45573 | | 6/2001 |
| WO | 0180686 | A2 | 11/2001 |
| WO | WO 01/80686 | | 11/2001 |

| | | | |
|---|---|---|---|
| WO | 02062174 | | 8/2002 |
| WO | WO 02/062174 | | 8/2002 |
| WO | 02071967 | A2 | 9/2002 |
| WO | WO 02/071967 | | 9/2002 |
| WO | 03030680 | A1 | 4/2003 |
| WO | WO 03/030680 | | 4/2003 |
| WO | 2004019801 | A2 | 3/2004 |
| WO | WO 2004/019801 | | 3/2004 |
| WO | WO 2004/026162 | | 4/2004 |
| WO | WO 2006/044964 | | 4/2006 |
| WO | 2008045819 | A3 | 6/2008 |

* cited by examiner

TOOTHBRUSH

CROSS-REFERENCE TO RELATED APPLICATIONS

This application is a continuation-in-part of U.S. application 10/870,462, filed Jun. 18, 2004 now U.S. Pat. No. 7,089,621, which is (1) a continuation-in-part of U.S. application 10/601,106, filed Jun. 20, 2003 now abandoned, (2) a continuation-in-part of PCT/US2003/030633, filed Sep. 26, 2003, which claims priority to U.S. Application 60/414,117, filed Sep. 27, 2002, U.S. Application 60/418,776, filed Oct. 16, 2002 and U.S. Application 60/419,425, filed Oct. 18, 2002, (3) a continuation-in-part of PCT Application PCT/US2003/029497, filed Sep. 17, 2003, which is a continuation of U.S. Application 60/412,290, filed Sep. 20, 2002, and (4) a continuation in part of U.S. application 29/189,729, filed Sep. 10, 2003 now U.S. Pat. No. D517,812. This application is also a continuation-in-part of U.S. application 10/869,922, filed Jun. 18, 2004 now U.S. Pat. No. 7,143,462. The contents of the above-noted applications are each expressly incorporated herein by reference.

FIELD OF THE INVENTION

The present invention pertains to a toothbrush with an enhanced cleaning head.

BACKGROUND OF THE INVENTION

A toothbrush is used to clean the teeth by removing plaque and debris from the tooth surfaces. Conventional toothbrushes provided with a flat bristle trim are limited in their ability to conform to the curvature of the teeth, to penetrate into the interproximal areas between the teeth, to sweep away the plaque and debris, and to clean along the gum line. Additionally, such toothbrushes have a limited ability to retain dentifrice for cleaning the teeth. During the brushing process, the dentifrice typically slips through the tufts of bristles and away from the contact between the bristles and the teeth. As a result, the dentifrice often is spread around the mouth, rather than being concentrated on the contact of the bristles with the teeth. Therefore, the efficiency of the cleaning process is reduced.

SUMMARY OF THE INVENTION

The invention pertains to a toothbrush with a novel arrangement of cleaning elements to provide superior cleaning of the teeth.

In one aspect of the invention, a toothbrush includes a head having a plurality of tooth cleaning elements extending from a base surface. The tooth cleaning elements generally define a loop arrangement to better retain the dentifrice proximate to the contact between the bristles and the teeth for more effective cleaning. In one preferred construction, each loop is formed by a plurality of independently flexible cleaning elements so as to maintain user comfort and provide improved cleaning of the teeth.

In another aspect of the invention, other cleaning elements are disposed within the cleaning elements forming the loop. In this construction, these central cleaning elements are strategically located to maximize the cleaning effect of the retained dentifrice.

In another aspect of the invention, tooth cleaning elements are positioned along the periphery of the head. In one preferred construction, these peripheral cleaning elements are stepped and tapered to clean along the gum line and reach the interproximal areas between the teeth.

The present invention also pertains to combinations of different kinds of cleaning elements on a single head that cooperate to provide a pattern for overall improved cleaning of the teeth, including effective cleaning of the rear teeth, the interproximal areas between the teeth, along the gum line, and the lingual and facial side surfaces of the teeth.

BRIEF DESCRIPTION OF THE DRAWINGS

A more complete understanding of the present invention and the advantages thereof may be acquired by referring to the following description in consideration of the accompanying drawings, in which like reference numbers indicate like features, and wherein.

DETAILED DESCRIPTION OF THE INVENTION

Figure 1:
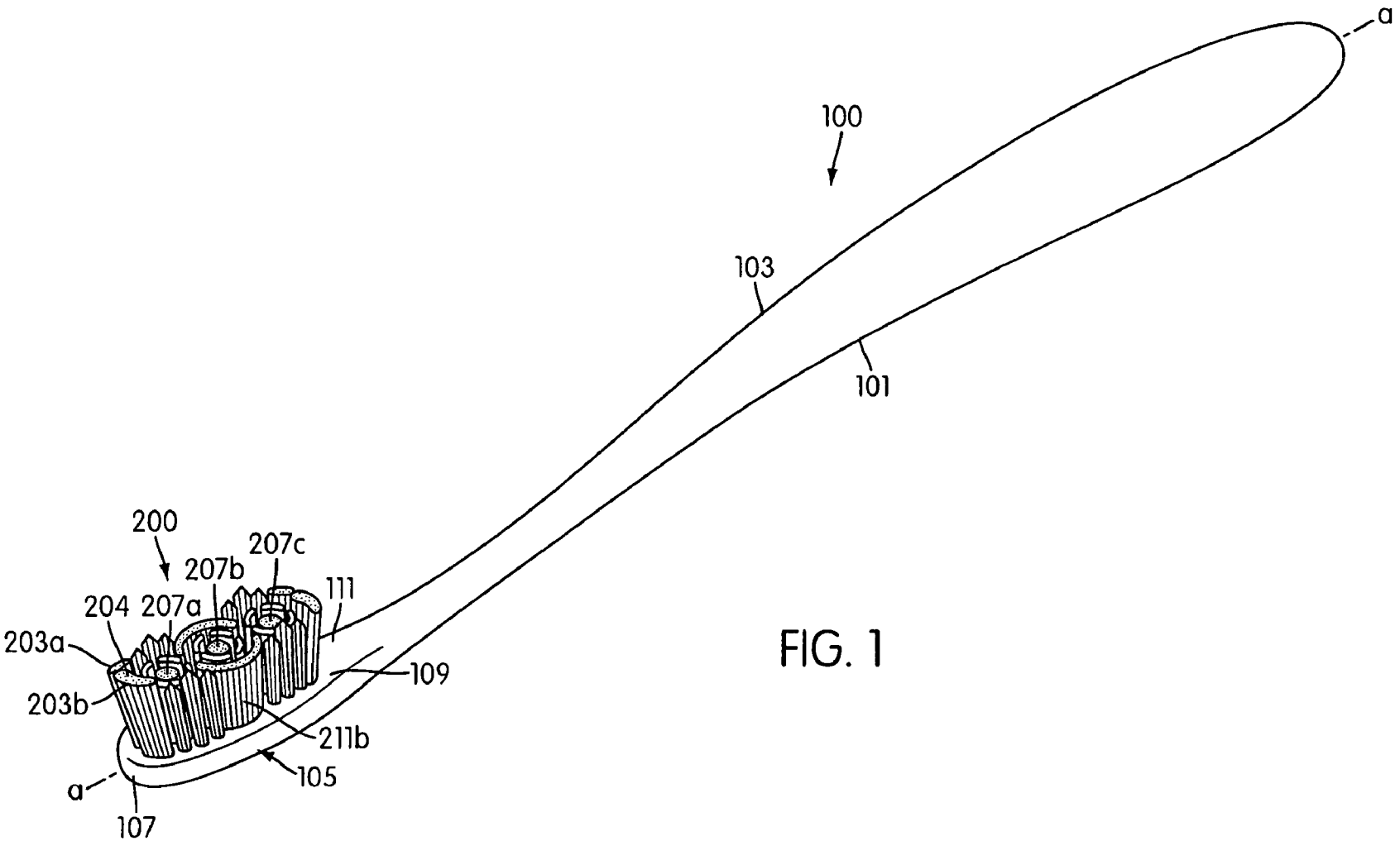
FIG. 1 is a perspective view of a toothbrush according to one or more aspects of an illustrative embodiment.

FIGS. 1-7 illustrate a toothbrush 100 having a support 101 including a handle 103 and a head 105, and tooth cleaning elements 200 for cleaning the user's teeth. Handle 103 is provided for the user to readily grip and manipulate the toothbrush 100, and may be formed of many different shapes and with a variety of constructions. Head 105 is the end portion of the support provided with tooth cleaning elements 200. The tooth cleaning elements can be attached to a base surface 109 of head 105 by any known means.

In a preferred construction, base surface 109 is provided with at least one group of cleaning elements 209 that collectively define a loop configuration 214 to better retain dentifrice among the tooth cleaning elements 200 and specifically between the contact of the cleaning elements and the teeth. While the loop configuration is preferably a circle, it could be in the form of a myriad of different closed loops including without limitation ovals, squares and irregular shapes. It is believed that the use of interior concave wall surfaces within the loop will best retain and move the dentifrice on the teeth especially when the toothbrush is generally moved in the desired small circular motions to brush the teeth. Nevertheless, other shapes can be used. The loop should simply define a substantially closed configuration to retain the dentifrice.

To better retain the dentifrice, each loop configuration is preferably defined by cleaning elements composed of elastomeric wall members. Although the loop configurations could be formed by tightly packed, elongate bristle tufts, such arrangements will permit a greater escape of the dentifrice than the elastomeric wall members. Further, although the loop configurations could be completely closed structures, they are preferably only substantially closed and each formed by a plurality of independently flexible cleaning elements

Figure 2:
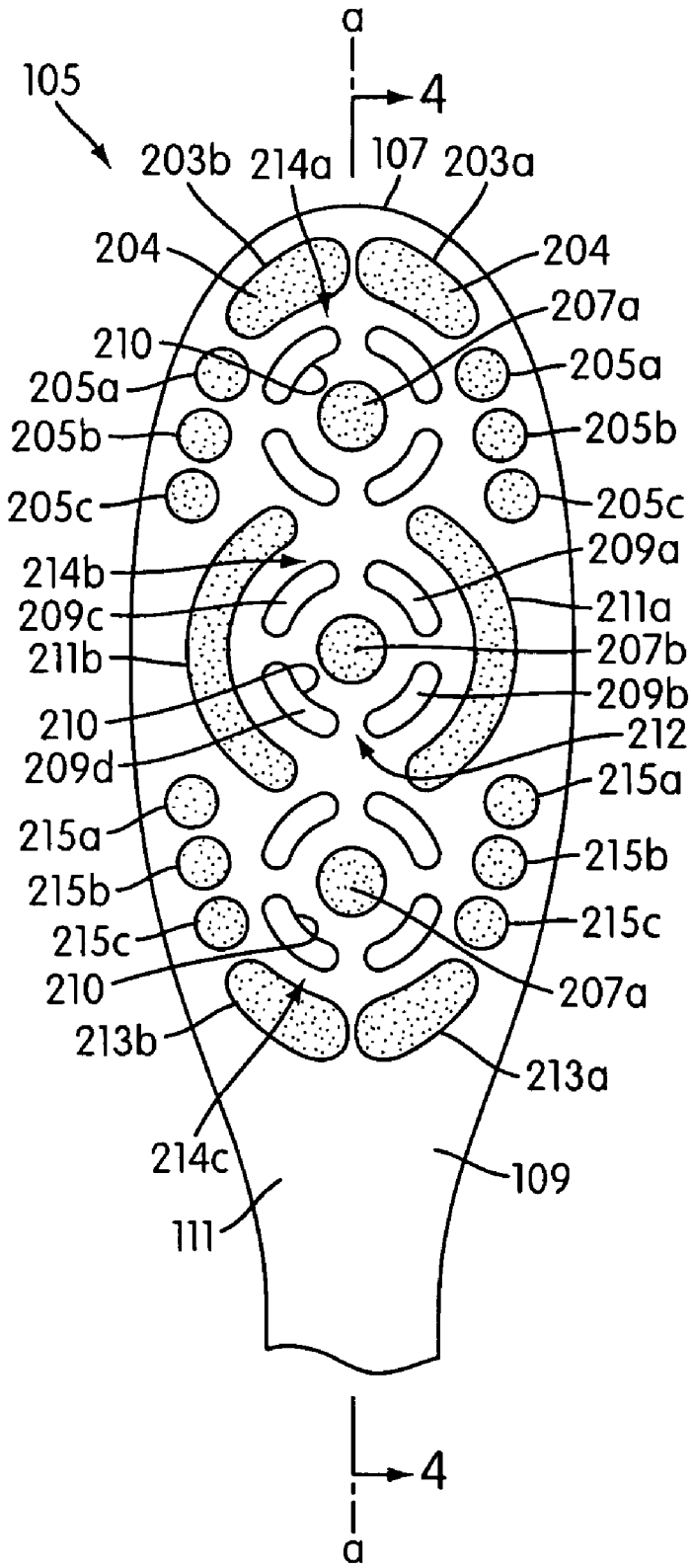
FIG. 2 is an enlarged plan view of a head section of the toothbrush of FIG. 1.

209*a-d*. In this way, the cleaning elements are able to provide a limited and controlled flow of the dentifrice to the outer cleaning elements and maintain sufficient flexibility to provide greater user comfort and improved cleaning by elements 209. In the preferred construction, as seen in FIG. 2, each loop construction is defined by four elastomeric wall members 209*a-d* each defining an arc segment that is approximately a quarter of a circle. As noted above, adjacent arc segments are spaced apart to define gaps 212 that permit a limited outward flow of dentifrice and independent flexing of each wall member. The gaps also aid the cleaning of cleaning elements 209 by permitting water to flush through the loops. The gaps, however, are preferably kept small to limit the escape of the dentifrice. While four segments have been illustrated to define each loop, other numbers of segments could be used. The wall members can be formed of any elastomeric material known for use as tooth cleaning elements. Finally, although the arc segments are preferably independent cleaning members, the loop could also be formed as a single member provided with slits to define gaps 212 and independently flexible cleaning elements 209*a-d*.

As best seen in FIG. 2, the preferred embodiment includes three loops 214*a-c* that are each positioned front to back along longitudinal axis a-a. In this way, a large portion of the dentifrice applied to the tooth cleaning elements can be retained to clean the user's teeth. Nevertheless, one, two or more than three loops could be used. Moreover, the loops could be arranged in other patterns including non-aligned arrangements or positioned off of axis a-a.

In a preferred construction, a central cleaning element 207 is disposed within each loop 214; although more than one central cleaning element 207 could be provided within each loop when larger loops are used. With this arrangement, dentifrice stays near the tips of cleaning elements 207 during a brushing operation for efficient cleaning. In the preferred construction, the concave nature of the inside surfaces of cleaning elements 209*a-d* directs the dentifrice to cleaning elements 207*a-c* during the sweeping or oscillating motion of head 105.

Central cleaning elements 207 are each preferably formed as bristle tufts for effectively cleaning the teeth. Nevertheless, one or more elastomer members may be used to form the distal cleaning elements in lieu of or in addition to the use of bristles.

The bristles of cleaning elements 203 as well as the bristles of other tufts discussed below are preferably composed of a nylon made from a material such as, for example, a nylon material marketed by Dupont under the name BRILLIANCE. Nevertheless, other materials could be used. The bristles in toothbrush 100 also preferably have a circular cross-sectional shape, but could have other cross-sections as well. The round bristles in toothbrush may be composed on a nylon marketed by Dupont under the name of TYNEX. The diameter of the round bristles are preferably 0.007 inches-0.008 inches thick or have other thicknesses depending on the desired cleaning action of the bristles. The tooth cleaning elements are connected to the toothbrush using known manufacturing methods for oral care products.

With reference to FIGS. 1 and 2, an additional outer ring of cleaning elements 211*a*, 211*b* is disposed in a central region of head 105 in a generally arcuate arrangement about cleaning elements 209*a-d* of central loop 214*b*. These outer arcuate cleaning elements 211*a-b* are preferably defined by two opposing arcuate cleaning elements which are arranged generally symmetrical on each side of the longitudinal axis a-a of head 105. As shown in FIG. 2, the outer cleaning elements 211*a-b* surround the loop cleaning elements 209*a-d* in the central region of head 105 to effectively use this space on the head. In a preferred arrangement, the loop cleaning elements 209*a-d* in the central region may be disposed generally concentrically within outer cleaning elements 211*a-b*. The dentifrice flowing through gaps 212 in the sides of loop 214*b* will be used by outer cleaning elements 211. While the outer arcuate cleaning elements 211*a, b* are preferably defined by elongate bristle tufts for effective brushing of the teeth, they could be formed of one or more elastomeric members in lieu of or in addition to the bristles.

Figure 4:
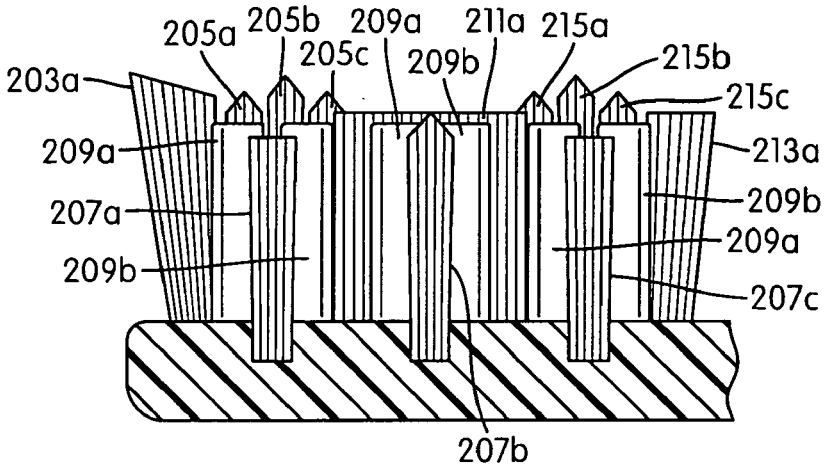
FIG. 4 is a section view of the head section taken along line 4-4 in FIG. 2.
Figure 5:
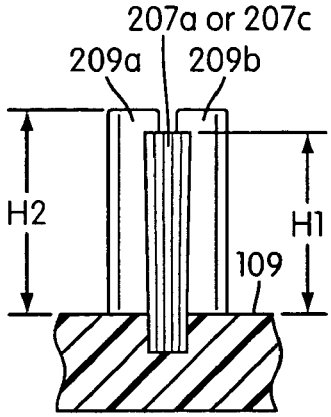
FIG. 5 is a partial section view of the head section similar to FIG. 4 showing a tooth cleaning element arrangement in isolation for clarity.
Figure 6:
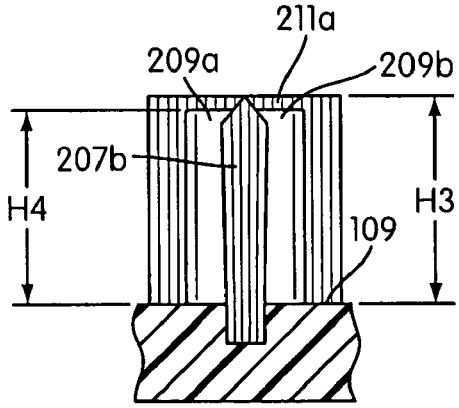
FIG. 6 is a partial section view of the head section similar to FIG. 4 showing another tooth cleaning element arrangement in isolation for clarity.
Figure 7:
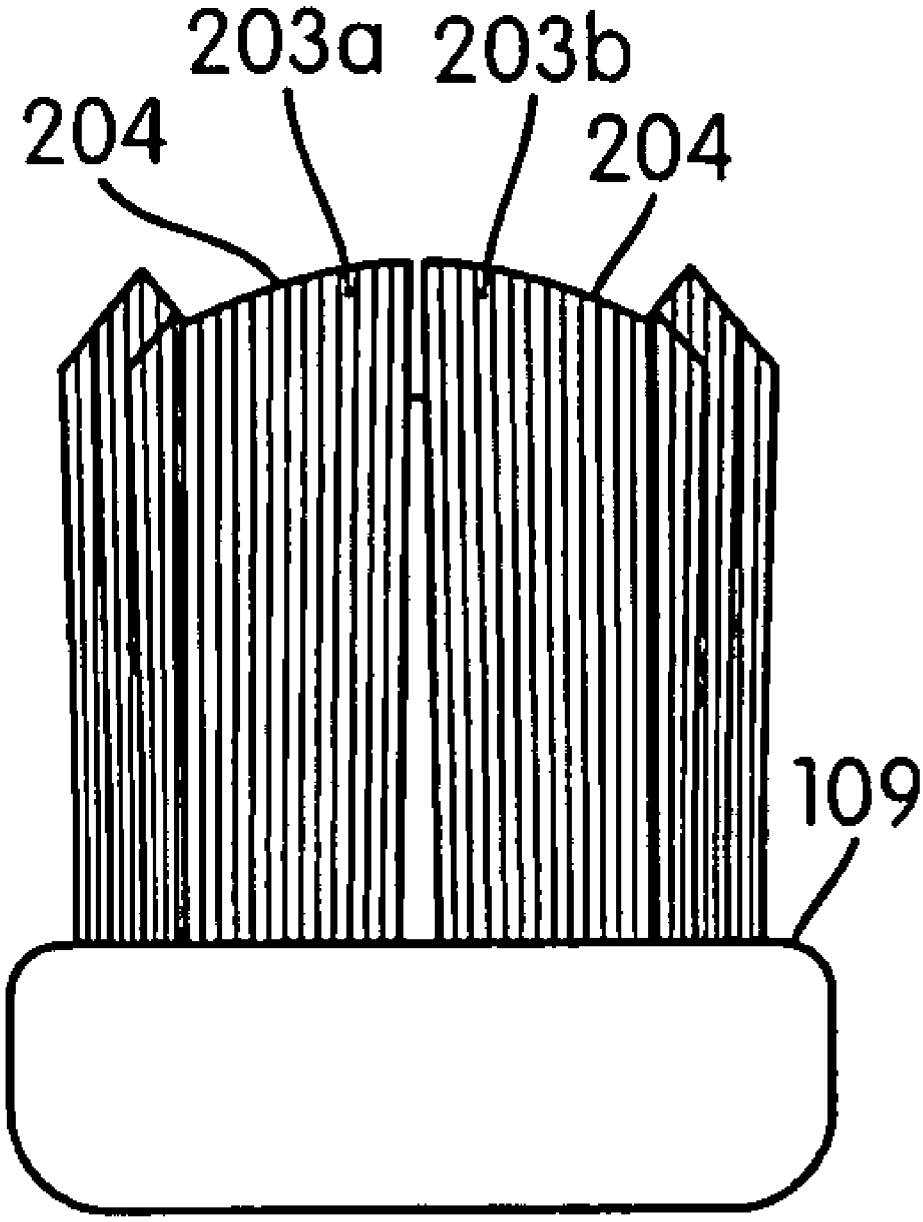
FIG. 7 is a distal end view of the head section of the toothbrush of FIG. 1.

FIGS. 4-6 are sectional views of head 105 that reveal the preferred height characteristics of cleaning elements 207, 209 and 211. In the preferred construction, central cleaning elements 207*a* and 207*c* are shorter than cleaning elements 209 forming loops 214*a*, 214*c* to facilitate enhanced brushing of the lingual and facial tooth surfaces with the dentifrice retained by loops 214*a, c*. The difference between the first height H1 of cleaning elements 207*a, c* and the second height H2 of cleaning elements 209 is preferably about 0.20-2.0 mm, but there could be other variations. Central cleaning element 207*b* is taller than cleaning elements 209 forming central loop 214*b* to facilitate better interproximal cleaning as well as cleaning of the crowns of the molars. The difference between the third height H3 of cleaning element 207*b* and the second height H2 of cleaning elements 209 is preferably about 0.20-2.0 mm, but other variations could be used. While this construction is preferred to maximize the cleaning of various surfaces in the mouth, other variations in the heights of the cleaning elements could be used as desired. For example, central cleaning elements 207 could all have the same heights with each other and as loop cleaning elements 209, or have heights that are higher or lower than the loop cleaning elements in different ways. In another example, the central cleaning elements 209 may have heights that are higher than the loop cleaning elements 209 in a staple configuration of toothbrush 100.

Head 105 also includes distal cleaning elements 203*a-b* at the free end 107. In the preferred construction, a pair of adjacent distal cleaning elements 203*a*, 203*b* straddle longitudinal axis a-a, although they could be formed by one or more than two cleaning elements. Distal cleaning elements 203*a-b* protrude higher from base surface 109 than the tips of the other tooth cleaning elements. The tips of each bristle tuft 203*a-b* collectively define an outermost cleaning surface 204 that is angled with respect to base surface 109 of head 105. By way of example, cleaning surface 204 is preferably at an angle Ø of about 30 degrees to base surface 109, but may also range between 10-50 degrees. It should be recognized that other angular values are possible. The extension and angular orientation of cleaning surface 204 of distal cleaning elements 203*a-b* better enable the user to reach and better clean the teeth in the back of the mouth. Cleaning elements 203*a-b* also can be used to dig into the crevices between the teeth and into the crown portions of the molars. Finally, as can been seen in FIG. 7, the outermost cleaning surface 204 also preferably is sloped laterally downward (to form a crowned surface) to assist in the removal of debris from the teeth.

Peripheral cleaning elements 205*a-c* are positioned near free end 107 and along each side 108 of head 105. These peripheral cleaning elements 205*a-c* are preferably formed by a plurality of bristle tufts that are arranged generally symmetrical with respect to the longitudinal axis a-a. Cleaning elements 205*a-c* are positioned rearward and laterally of distal cleaning elements 203*a-b*. Similarly, peripheral cleaning elements 215*a-c* are also positioned symmetrically about axis a-a along each side 108 near proximal end 111 of head 105. These two groups of cleaning elements 205*a-c*, 215*a-c* are generally mirror images of each other, but could have other constructions. Both the distal and proximal peripheral cleaning elements 205*a-c*, 215*a-c* are generally configured to enable the user to clean along the gum line and in the crevices between the teeth. In the illustrative embodiment, three bristle tufts form each group of peripheral cleaning elements 205*a-c*, 215*a-c*. Nevertheless, more or fewer bristle tufts in these groups may be used. Further, one or more elastomeric elements may be used to define the peripheral cleaning elements in place of or with the bristles.

Figure 3:
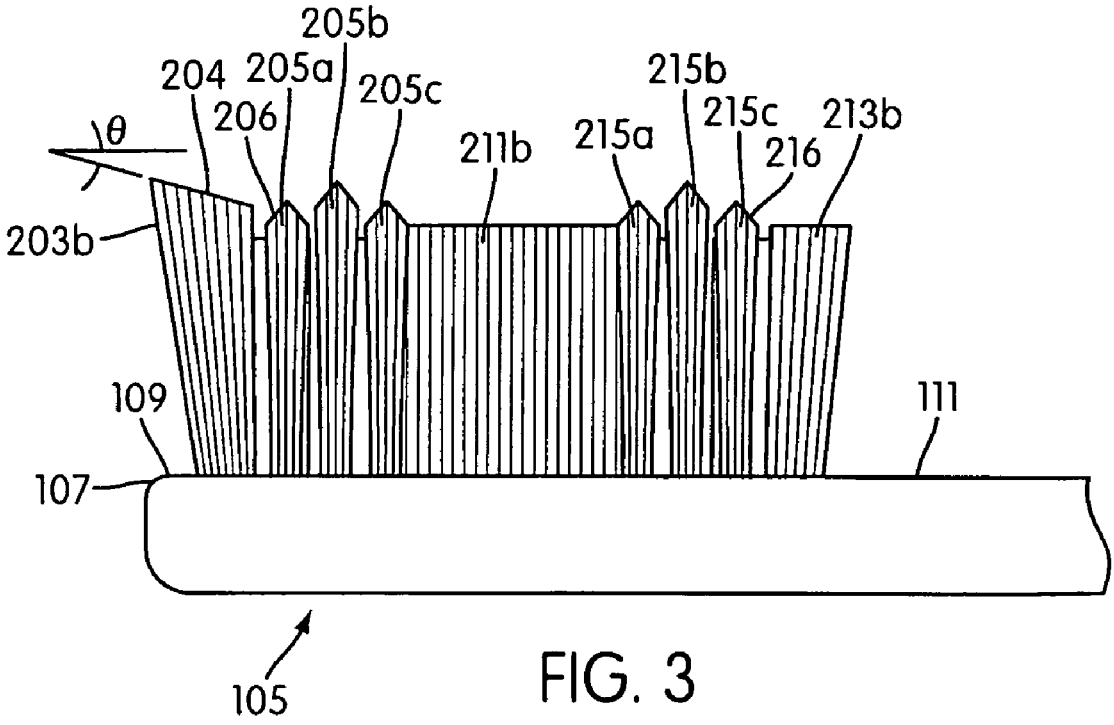
FIG. 3 is an enlarged side view of a head section of the toothbrush of FIG. 1.

As shown in FIG. 3, the tips of the peripheral cleaning elements 205*a-c* and 215*a-c* protrude higher from base surface 109 than the tips of the interior cleaning elements 207, 209, 211. In a preferred embodiment, two groups of peripheral cleaning elements 205, 215 are arranged along each side 108 of head 105. Each group of peripheral cleaning elements includes three generally aligned tufts of bristles, although other numbers of tufts could be used. The center tuft of cleaning elements 205*b*, 215*b* in each group of peripheral cleaning elements protrudes outward farther from base surface 109 than the others tufts 205*a*, 205*c*, 215*a*, 215*c*. This arrangement allows deeper engagement of the tooth surfaces along the gum line with cleaning elements 205*b* or 215*b*, while stimulating the gums with cleaning elements 205*a*, 205*c* and 215*a*, 215*c*. Moreover, each of the tufts has tapered ends 206, 216 to improve the cleaning of the interproximal areas and along the gum line.

Proximal cleaning elements 213*a-b* are positioned near the proximal end 111 of head 105. Preferably a pair of bristle tufts straddle longitudinal axis a-a, but one or more than two cleaning elements could be formed at the proximal end of the head. These proximal cleaning elements 213*a,b* are preferably defined by bristle tufts, but could also include or be defined by one or more elastomeric members.

While the bristles are discussed above as being preferably 0.007 inches-0.008 inches thick, it may be desirable to have thinner bristles to provide for a more comfortable feel. For example, some of the cleaning elements discussed above could be formed with bristles that are approximately 0.004 inches to 0.005 inches thick, which are generally recognized in the trade as "extra soft" bristles used in toothbrushes for consumers with sensitive teeth, while other bristles included in tufts such as 203 and 213 might be slightly thicker (e.g., approximately 0.006 inches thick) to minimize premature wear on such tufts of bristles. Alternatively, the majority of the bristles could be 0.006 inches thick, which is still considered "soft" as compared with traditional bristles that are 0.007-0.008 inches thick. Benefits of the use of thinner bristles include better cleaning through a thinner bristle tip with increased penetration capabilities, increased comfort through bristles that are easy on the gums and sensitive teeth, and improved bristle wear from the use of very soft bristles.

Additional benefits are obtained by using thin bristles in combination with elastomeric cleaning elements 209. Whereas isolated regions of thin bristles (205, 211, 215 for example) might tend to collapse or "mash down" in response to normal brushing, the use of elastomeric cleaning elements would act to prevent excess wear of the bristles by restricting the penetration of those bristles. In other words, the bristles are allowed to stand mostly straight throughout brushing which is not typical with very soft bristle brushes. Thus, the elastomeric cleaning elements function as a stop or barrier to the overextension of the brush downward toward the user's teeth, as well as toward the back of the user's mouth. Since extra soft bristles provide minimal resistance to movement across the teeth, there is a danger that the user might overextend the brushing stroke and force the free end 107 of the brush into contact with the back of the user's mouth or gums. Thus, the use of elastomeric cleaning elements in combination with extra soft bristles would provide the added resistance necessary to prevent overextension of the brushing stroke.

To further promote or visually communicate the soft feeling of the bristles, such bristles could be semi-transparent or translucent. The interaction of translucent bristles with elastomeric cleaning elements 209 creates several interesting phenomena. First, in the present embodiment, the elastomeric cleaning elements surround, and are surrounded by, bristles, such that the toothbrush head exhibits a colored glow based on the color of the elastomeric elements and the manner in which light is retained, reflected and refracted in and around the elastomeric elements and translucent bristles. Thus, colored elastomer (or the like) embedded within a translucent bristle field emits a glow that is further reflective and demonstrative of the sensitive nature of the soft bristles and tends to appear softer than simply a solid color standing alone. This tends to be particularly evident when view in perspective (such as FIG. 1).

However, when the brush is viewed from the side as in FIGS. 3 and 4, additional visual highlights become pronounced. First, because the translucent bristles surround the colored elastomeric members, the presence of the elastomeric members becomes apparent through the bristles. Thus, the bristles from the side of the brush assume a two-toned appearance that is darker along most of the bristle length and lighter at the bristle tips (i.e., H3-H4 in FIG. 6), which appearance is obtained through the spatial interaction between the colored elastomeric members in the background that partially show their color and existence through the translucent bristles in the foreground. Second, because the colored elastomeric members are shorter (FIG. 4) than the translucent bristles, the bristle tips become highlighted when the brush is viewed from the side as there are no colored members in the background to "dull" the appearance of the tips. Thus, the "highlighted" bristle tips, which tend to be the focus of attention, also tend to be the first location to exhibit and show wear. Therefore, the interaction between the colored members and the translucent bristles as discussed above creates a pseudo-wear indicator in that the eye is drawn to the highlighted tip and the one location of the bristle that is first likely to exhibit wear. Such a wear indicator would avoid the need to get up close and personal with the bristles to determine if there is excessive wear on the bristles.

A similar two-toned bristle appearance can be created by end-rounding the translucent bristle tips to create a French Manicure-type of tip that appears "opaque" as compared with the remainder of the translucent bristle that appears "shiny." By varying the penetration of the end rounding units on the bristles, the depth of the opaque or shiny appearance can be similarly varied. However, the end-rounding and subsequent removal of the "shine" also makes the end-rounded surface slightly more abrasive, which could provide greater cleaning efficacy.

In addition, the tips of a plurality, majority, or most of the soft bristles could be tapered to create an even finer bristle tip, which feature is consistent with the use of tapered bristles on traditional "sensitive" brushes. Such tapered bristles would preferably extend around the periphery of the brush head where contact is first made between the bristles and the gingival tissue. Bristles 207 could also be tapered as desired.

The inventive aspects may be practiced for a manual toothbrush or a powered toothbrush. In operation, the previously described features, individually and/or in any combination, improves cleaning performance of toothbrushes. These advantages are also achieved by the cleaning elements and the synergistic effects. While the various features of the toothbrush 100 work together to achieve the advantages previously described, it is recognized that individual features and subcombinations of these features can be used to obtain some of the aforementioned advantages without the necessity to adopt all of these features. This unique combination of elements gives exceptional cleaning power in a compact head space.

While the invention has been described with respect to specific examples including presently preferred modes of carrying out the invention, those skilled in the art will appreciate that there are numerous variations and permutations of the above described systems and techniques. Thus, the spirit and scope of the invention should be construed broadly as set forth in the appended claims.

What is claimed is:

1. A toothbrush comprising:

a head and a handle extending therefrom, the head further comprising:

a central bristle tuft comprising a plurality of bristles having a thickness of 0.006 inches or less;

an elastomeric barrier that prevents overextension of the plurality of bristles of the central bristle tuft toward a user's teeth during brushing, wherein the elastomeric barrier defines a loop and the central bristle tuft is disposed within the loop; and wherein the central bristle tuft extends a first height from a surface of the head and the elastomeric barrier extends a second height from the surface of the head, wherein the first height is greater than the second height.

2. The toothbrush of claim 1, wherein the head further comprises a longitudinal axis and the central bristle tuft is positioned on the longitudinal axis.

3. The toothbrush of claim 1, wherein the thickness of the bristles of the central bristle tuft ranges from 0.005 to 0.006 inches.

4. The toothbrush of claim 1, wherein the head further comprises a first plurality of tooth cleaning elements positioned outside of the loop.

5. The toothbrush of claim 4, wherein at least some of the first plurality of tooth cleaning elements are tapered bristles.

6. The toothbrush of claim 1, wherein the head further comprises a first plurality of tooth cleaning elements that partially surround the elastomeric barrier.

7. The toothbrush of claim 6, wherein the first plurality of tooth cleaning elements are transparent or translucent bristles, and the elastomeric barrier is opaque.

8. The toothbrush of claim 1, further comprising a first plurality of tooth cleaning elements positioned outside of the loop and a second plurality of tooth cleaning elements having a greater thickness than the central bristle tuft.

9. The toothbrush of claim 8, wherein the first plurality of tooth cleaning elements have a thickness of 0.006 inches or less.

10. The toothbrush of claim 1, wherein the elastomeric barrier comprises a plurality of arcuate wall segments that collectively define the loop.

11. A toothbrush comprising:

a head and a handle extending therefrom;

the head comprising a wear indicator having a two-toned appearance that exhibits wear of a plurality of transparent or translucent bristles;

the two-toned appearance obtained through spatial interaction between the bristles and a plurality of colored elastomeric walls;

wherein the plurality of colored elastomeric walls are shorter than the plurality of bristles such that the plurality of bristles have a tip portion that extends beyond the colored elastomeric walls and a base portion adjacent the colored elastomeric walls; and wherein when viewed from a side of the head, the plurality of bristles have the two-toned appearance in which the base portions of the plurality of bristles have a darker appearance due to the colored elastomeric walls being visible through the base portions of the plurality of bristles and the tip portions of the plurality of bristles have a lighter appearance due to being unaffected by the colored elastomeric walls.

12. The toothbrush of claim 11, wherein the plurality of colored elastomeric walls are opaque.

13. The toothbrush of claim 11, wherein at least some of the plurality of bristles are tapered bristles.

14. The toothbrush of claim 13, wherein the head further comprises a longitudinal axis;

wherein the tapered bristles are arranged along the periphery of the head; and wherein the plurality of colored elastomeric walls form a plurality of loops arranged along the longitudinal axis.

15. The toothbrush of claim 11, wherein the plurality of tooth cleaning elements have a thickness of approximately 0.005 inches to 0.006 inches.

16. The toothbrush of claim 11, wherein the plurality of bristles have a thickness of 0.006 inches or less.

* * * * *